US011405727B2

(12) United States Patent
Gunn

(10) Patent No.: US 11,405,727 B2
(45) Date of Patent: Aug. 2, 2022

(54) SPEAKER

(71) Applicant: ARRIS Enterprises LLC, Suwanee, GA (US)

(72) Inventor: Stuart Gunn, Los Angeles, CA (US)

(73) Assignee: ARRIS ENTERPRISES LLC, Suwanee, GA (US)

( * ) Notice: Subject to any disclaimer, the term of this patent is extended or adjusted under 35 U.S.C. 154(b) by 0 days.

(21) Appl. No.: 17/232,498

(22) Filed: Apr. 16, 2021

(65) Prior Publication Data

US 2022/0060833 A1 Feb. 24, 2022

Related U.S. Application Data

(60) Provisional application No. 63/069,335, filed on Aug. 24, 2020.

(51) Int. Cl.

| | |
|---|---|
| ***H04R 1/02*** | (2006.01) |
| ***H04R 9/02*** | (2006.01) |
| ***H04R 9/06*** | (2006.01) |

(52) U.S. Cl.

CPC ..... *H04R 9/022* (2013.01); *H04R 1/02* (2013.01); *H04R 1/026* (2013.01); *H04R 1/028* (2013.01); *H04R 9/06* (2013.01); *H04R 2201/025* (2013.01); *H04R 2201/028* (2013.01)

(58) Field of Classification Search

CPC ..... H04R 1/02; H04R 1/026; H04R 1/028; H04R 1/2834; H04R 9/022; H04R 9/06; H04R 2201/025; H04R 2201/028

See application file for complete search history.

(56) References Cited

U.S. PATENT DOCUMENTS

| | | | | |
|---|---|---|---|---|
| 2013/0175923 | A1 | 7/2013 | Yotsumoto et al. | |
| 2016/0231090 | A1* | 8/2016 | Bishop | H04R 17/00 |
| 2020/0053452 | A1 | 2/2020 | Fallon | |
| 2021/0303041 | A1* | 9/2021 | Minnehan | H04R 9/06 |
| 2021/0304744 | A1* | 9/2021 | Pawar | G10L 15/22 |

OTHER PUBLICATIONS

International Search Report and the Written Opinion of the International Searching Authority dated Jul. 14, 2021 in International (PCT) Application No. PCT/US2021/027635.

* cited by examiner

*Primary Examiner* — Huyen D Le
(74) *Attorney, Agent, or Firm* — Wenderoth, Lind & Ponack, L.L.P.

(57) ABSTRACT

A speaker includes a shell, a speaker housing, and a heat sink. The heat sink is fixed inside the shell. The speaker housing is mounted to the heat sink such that the speaker housing is suspended from the heat sink inside the shell. An interior of the speaker housing is spheroidal.

20 Claims, 17 Drawing Sheets

SPEAKER

TECHNICAL FIELD

The subject matter of the present disclosure relates generally to a speaker including a heat sink and a spheroidal speaker housing mounted to the heat sink.

BACKGROUND

Popular electronic apparatuses in many homes include traditional speakers, and smart speakers. These speakers house electronic circuits that convert electrical audio input signals into sounds for playing data such as audio media content including radio programming and podcasts. The speakers typically include a speaker housing, a driver and a radiator.

Existing solutions feature speaker housings with parallel internal surfaces. Since soundwaves can bounce along parallel paths between the parallel internal surfaces, standing waves, internal reflections, and reverberations on certain tones are exacerbated. As such, the sound quality of the existing solutions is substantially impaired.

Furthermore, the mounting arrangements of current solutions transfer mechanical or vibrational noise to circuit boards thereby requiring considerable software filtering such as digital signal processing (DSP) or active noise control (ANC). This increases the cost and complexity of the speakers.

Thus, it would be advantageous and an improvement over existing solutions to provide a speaker that minimizes acoustic reflection, maximizes performance of the driver and the radiator, and produces the most ideal sound while using the least amount of power.

SUMMARY

An embodiment of the present disclosure provides a speaker. The speaker includes a shell, a speaker housing, and a heat sink. The heat sink is fixed inside the shell. The speaker housing is mounted to the heat sink such that the speaker housing is suspended from the heat sink inside the shell. An interior of the speaker housing is spheroidal.

BRIEF DESCRIPTION OF THE DRAWINGS

In the drawings, like reference numbers generally indicate identical, functionally similar, and/or structurally similar elements.

DETAILED DESCRIPTION

The following detailed description is made with reference to the accompanying drawings and is provided to assist in a comprehensive understanding of various example embodiments of the present disclosure. The following description includes various details to assist in that understanding, but these are to be regarded as merely examples. Accordingly, those of ordinary skill in the art will recognize that various changes and modifications of the examples described herein can be made without departing from the spirit and scope of the present disclosure. In addition, descriptions of well-known functions and constructions may be omitted for clarity and conciseness.

The terms and words used in the following description and claims are merely used to enable a clear and consistent understanding of the present disclosure. Accordingly, it should be apparent to those skilled in the art that the following description of the present disclosure is provided for illustration purposes only, and not for the purpose of limiting the present disclosure as defined by the appended claims and their equivalents.

The speaker disclosed herein provides a heat sink and a speaker housing mounted to the heat sink. An interior of the speaker housing is spheroidal. The speaker minimizes acoustic reflection, maximizes performance of the driver and the radiator, and produces the most ideal sound while using the least amount of power.

The speaker disclosed herein addresses and solves the following problems:

How to minimize acoustic reflection.

How to maximize driver performance.

How to fully utilize a radiator.

How to reduce mechanical or vibrational noise transferred to circuit boards.

How to improve cooling/heat transfer/heat reduction of circuit boards.

How to reduce the requisite amount of software filtering for sound output.

How to produce the most ideal sound while using the least amount of power.

How to reduce the cost of a speaker.

How to provide a speaker subassembly that can be powered and tested externally from a shell thereof.

How to provide a speaker with a simple power cable arrangement.

How to leverage the solution to the above-mentioned problems in a speaker with a minimal number of parts and less complexity.

The speaker disclosed herein solves the problems identified above and provide an efficient and cost effective solution to minimizing acoustic reflection, maximizing performance of the driver and the radiator, and producing the most ideal sound while using the least amount of power.

Figure 1:
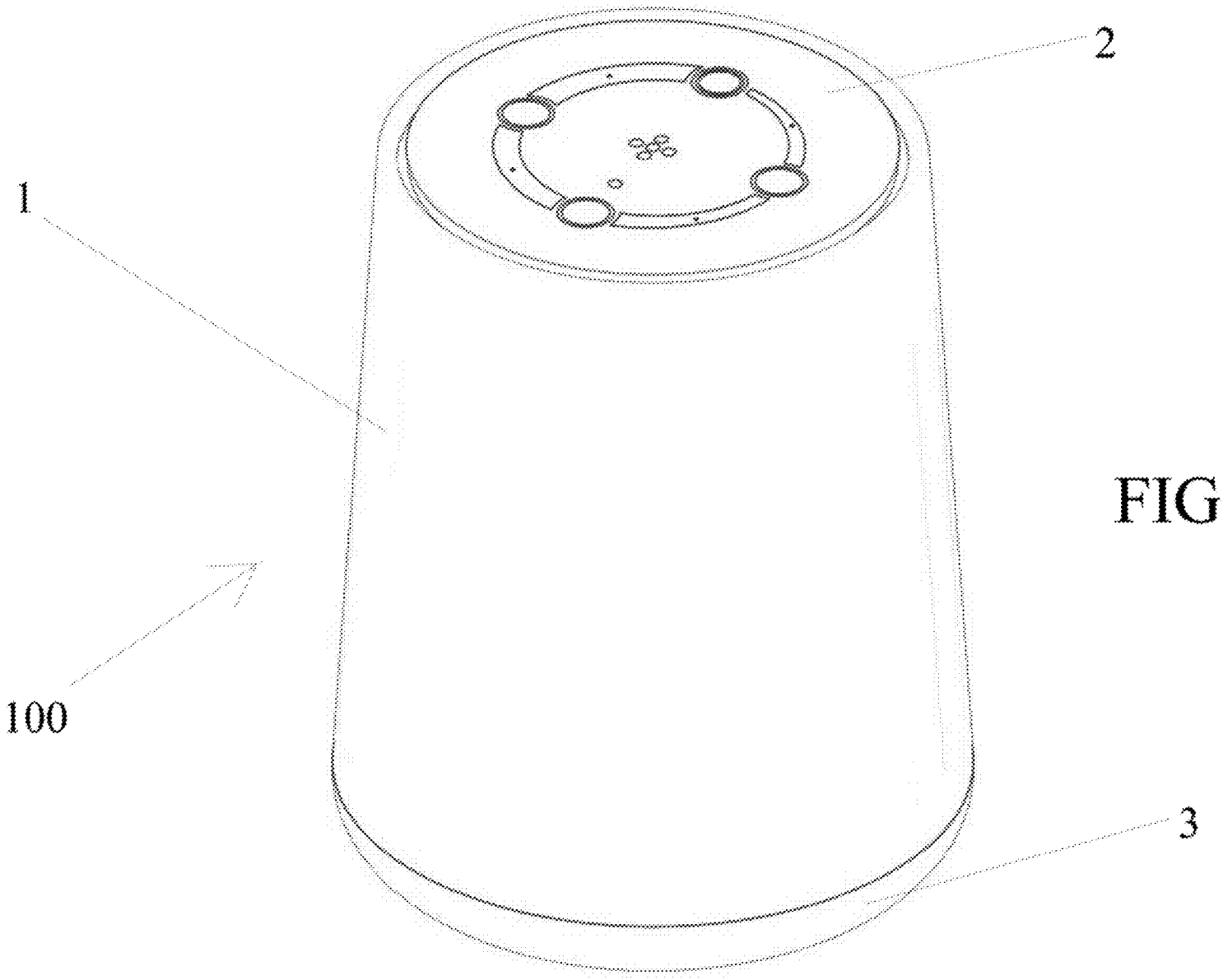
FIG. 1 is a perspective view of a speaker according to a first embodiment of the present disclosure.

FIG. 1 is a perspective view of a speaker 100 according to the present disclosure. The speaker 100 includes a covering 1, a cap 2, and a base 3.

Figure 2:
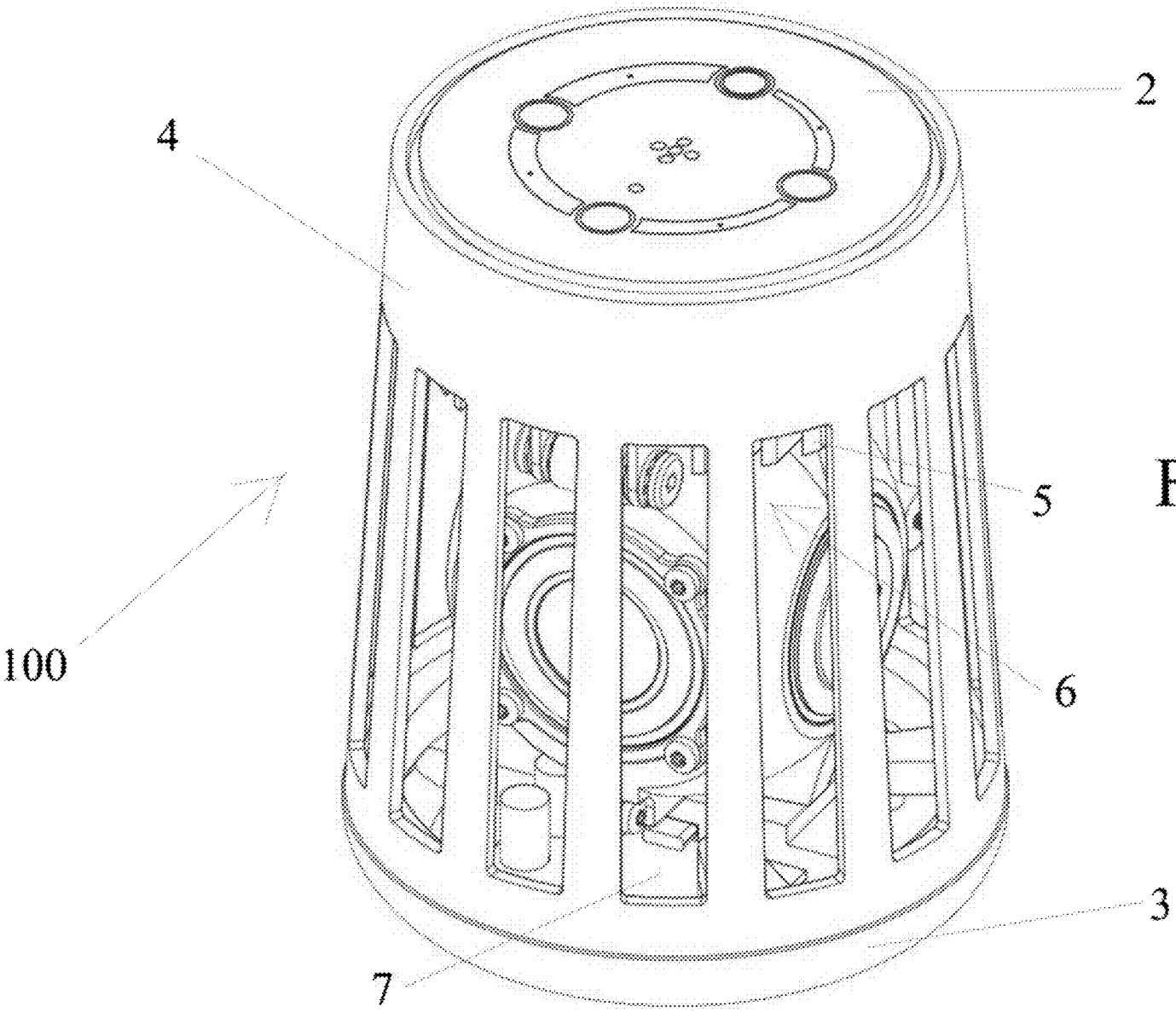
FIG. 2 is a perspective view of the speaker (without a covering) according to the first embodiment of the present disclosure.

FIG. 2 is a perspective view of the speaker 100 (without the covering 1) according to a first embodiment of the present disclosure. The speaker 100 includes a shell 4 and a speaker subassembly. The shell 4 is fixed to the base 3. The speaker subassembly includes a heat sink 5 and a speaker housing 6. The cap 2 is fixed to the heat sink 5.

The heat sink 5 is fixed inside the shell 4 and the speaker housing 6 is mounted to the heat sink 5 such that the speaker housing 6 is suspended from the heat sink 5 inside the shell 4. For example, the shell 4 may include a ledge (not shown) for supporting the heat sink 5. The speaker housing 6 can be mounted directly to the heat sink 5 without any intervening elements therebetween. By mounting the speaker housing 6 directly to the heat sink 5, the number of parts needed for assembly can be reduced and the heat sink 5 is provided a clear air flow path for greater heat reduction of various elements of the speaker 100.

A circuit board 7 may be fixed to the base 3. In some variations, the circuit board 7 may be a printed circuit board (PCB) for Universal Serial Bus Type-C (USB-C) power delivery. The cap 2, the heat sink 5, and the speaker housing 6 are configured to be inserted into the shell 4 together from above. Accordingly, the design is simplified and the speaker subassembly can be powered and tested externally from the shell 4 and only a power cable (not shown) is needed to connect to the USB-C Power PCB 7 within the base 3.

Figure 3:
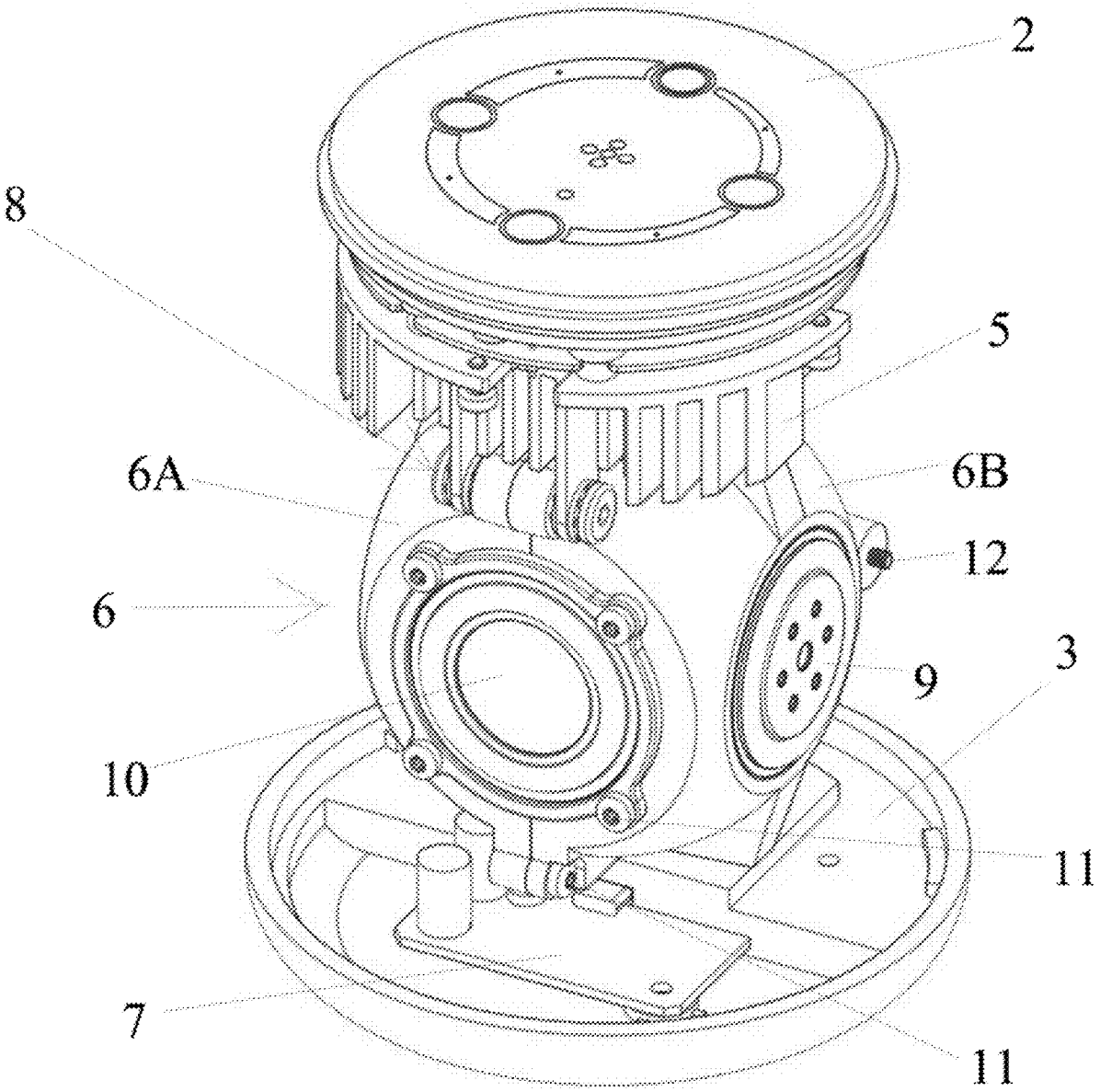
FIG. 3 is a perspective view of a speaker subassembly, a cap, and a base according to the first embodiment of the present disclosure.
Figure 8:
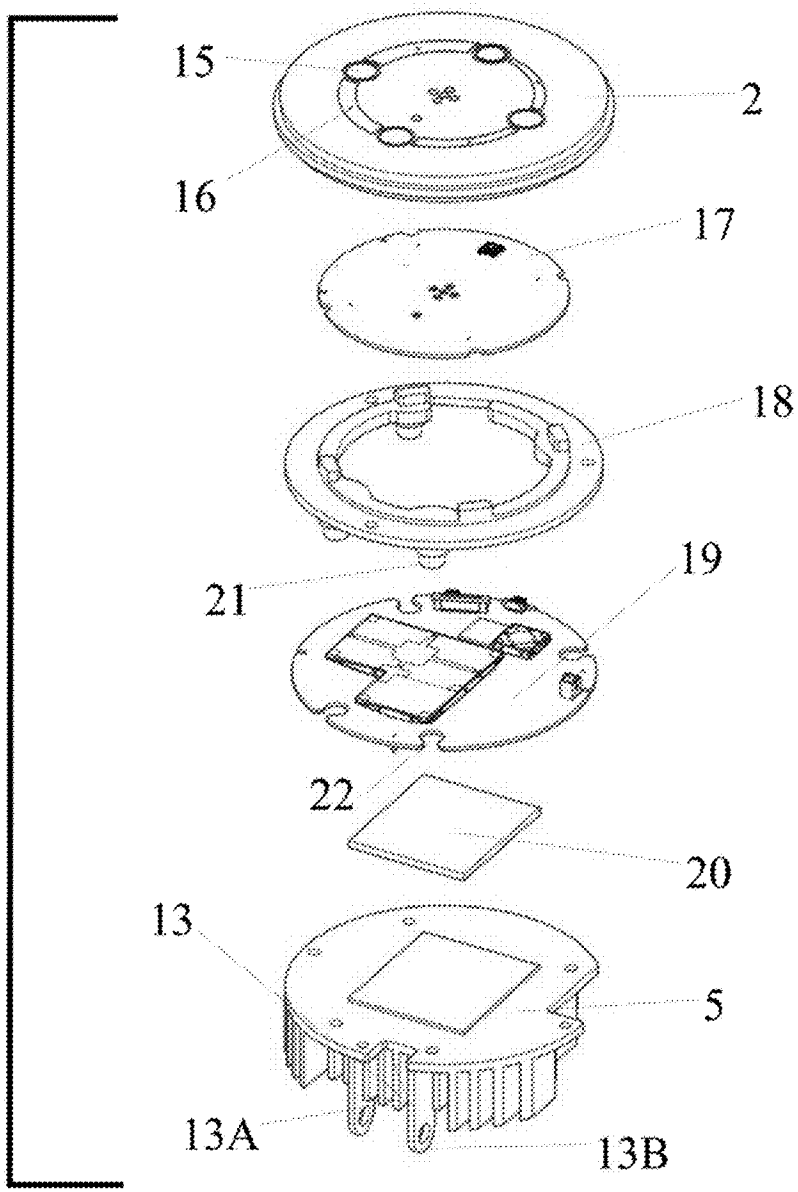
FIG. 8 is an exploded perspective view of the heat sink and the cap according to the first embodiment of the present disclosure.

FIG. 3 is a perspective view of the speaker subassembly, the cap 2, and the base 3 according to the first embodiment of the present disclosure. The speaker housing 6 is mounted to the heat sink 5 via at least one fastener 8. The speaker 100 may include a radiator 9 and a driver 10. Each of the radiator 9 and the driver 10 may be fixed to the speaker housing 6. The radiator 9 may be a passive radiator which is powered by a change in air pressure generated from the driver 10. Furthermore, the speaker housing 6 may be sealed such that the speaker housing 6 is an acoustic suspension enclosure which is airtight. Consequently, the most ideal sound can be obtained from a compact speaker while using the least amount of power. The speaker housing 6 may be separable into multiple sections 6A, 6B which are fixed together via at least one fastener 11. The driver 10 may also be fixed to the speaker housing 6 via at least one fastener 11. In some variations, each fastener 11 may be a self-tapping screw. Additional fasteners 12 may also be provided for positive (+) and negative (−) connections to the driver 10 from a Main Control PCB (for example, circuit board 19 as shown in FIG. 8). In other words, positive (+) and negative (−) connections of the driver 10 may be attached to internal sides of the fasteners 12, which may be comprised of nuts, bolts and washers (not shown). A corresponding cable (not shown) may be connected to an external portion of the fastener 12 and connected to a speaker output connection on the Main Control PCB.

Figure 4:
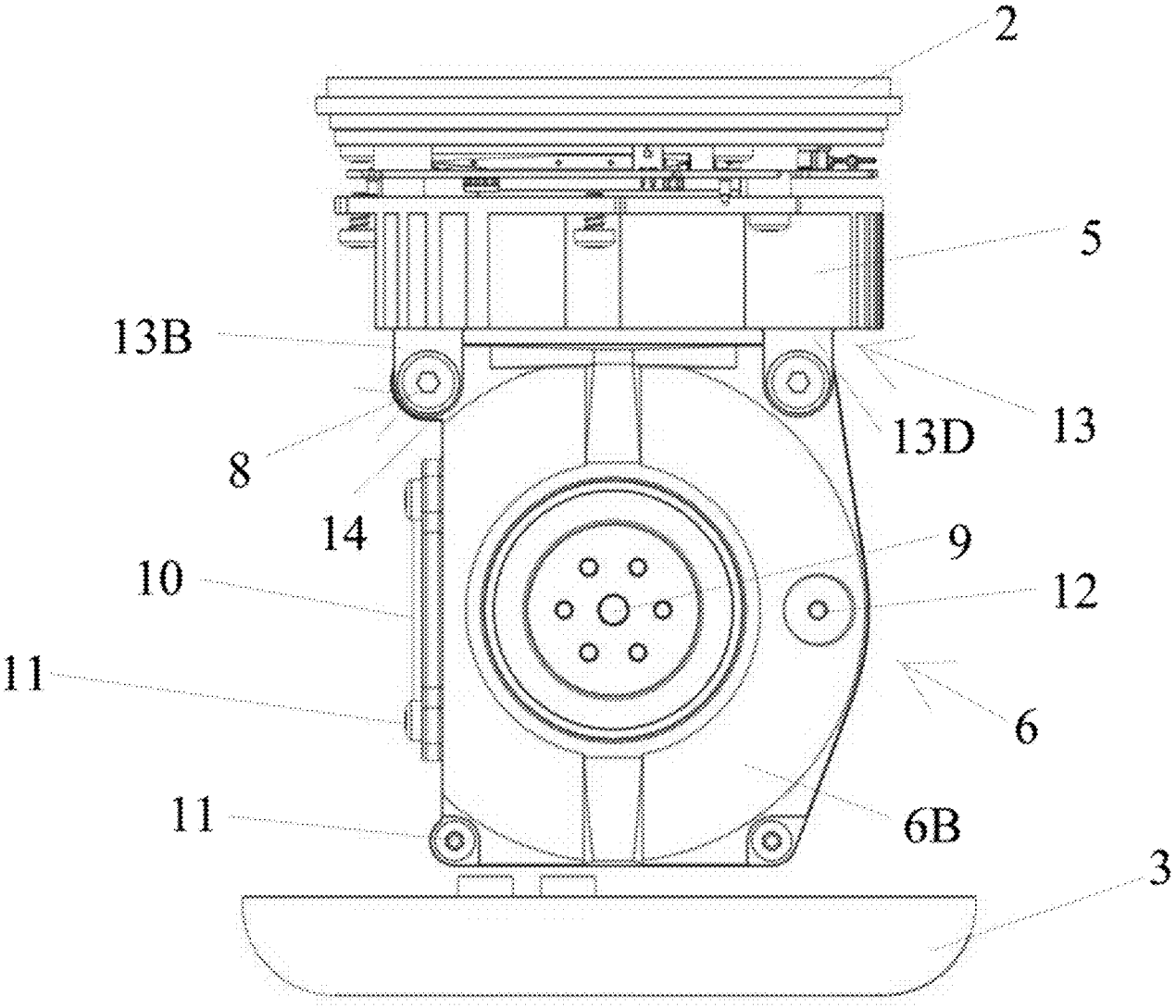
FIG. 4 is a side view of the speaker subassembly, the cap, and the base according to the first embodiment of the present disclosure.

FIG. 4 is a side view of the speaker subassembly, the cap 2, and the base 3 according to the first embodiment of the present disclosure. In the first embodiment of the present disclosure, the heat sink 5 includes an attachment structure 13 on an underside thereof and the speaker housing 6 includes at least one projection 14. For example, the attachment structure 13 includes flanges 13A-13D extending therefrom. The projections 14 are fixed to the flanges 13A-13D via the fasteners 8 (see also FIG. 9).

Figure 5:
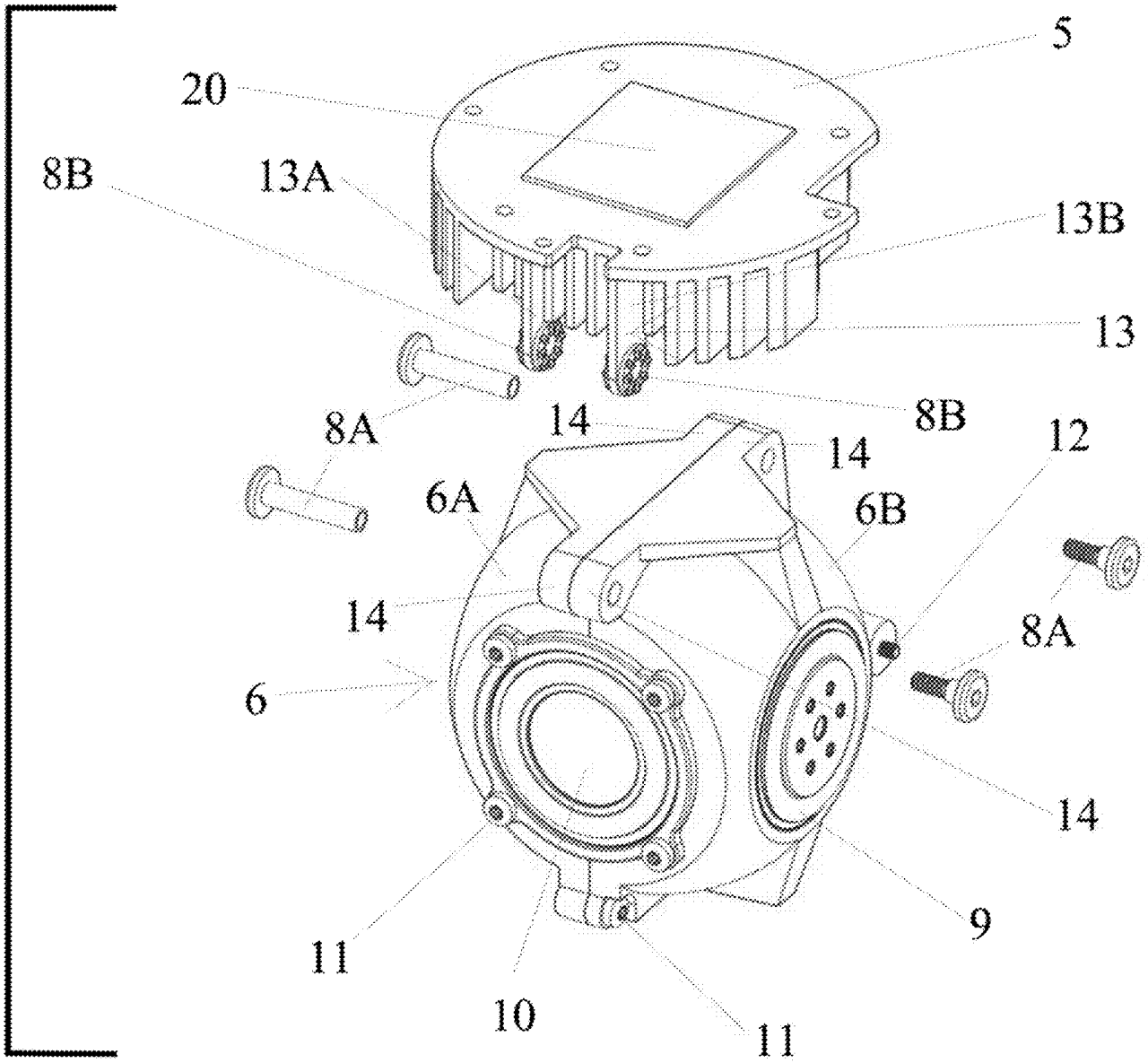
FIG. 5 is an exploded perspective view of the speaker subassembly according to the first embodiment of the present disclosure.

FIG. 5 is an exploded perspective view of the speaker subassembly according to the first embodiment of the present disclosure. In the first embodiment of the present disclosure, each fastener 8 includes at least one of a Chicago screw 8A or a grommet 8B. The Chicago screw 8A may include, for example, a female threaded nut (e.g., left portion of 8A) and a male threaded screw (e.g., right portion of 8A). For example, (i) one female threaded nut (e.g., left portion of 8A) can be inserted through a first flange 13A of the heat sink 5 including a grommet 8B, two projections 14 of the speaker housing 6, and a second flange 13B of the heat sink 5 including a grommet 8B; and (ii) the male threaded screw (e.g., right portion of 8A) can be secured to the female threaded nut (e.g., left portion of 8A). In some variations, four Chicago screws 8A and four grommets 8B may be provided. One grommet 8B can be attached to or integrated with each of the flanges 13A-13D.

Figure 6:
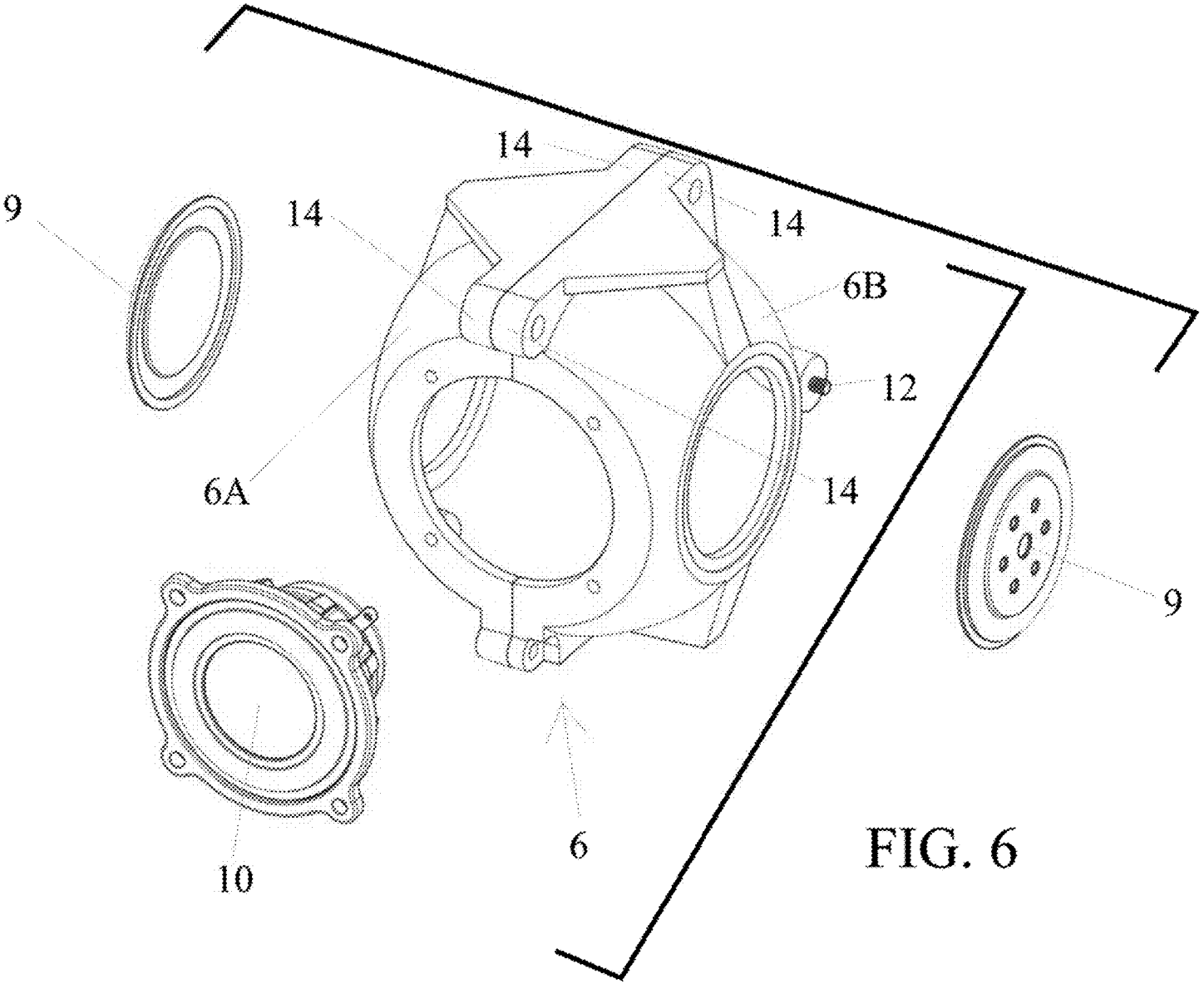
FIG. 6 is an exploded perspective view of part of the speaker subassembly according to the first embodiment of the present disclosure.

FIG. 6 is an exploded perspective view of part of the speaker subassembly according to the first embodiment of the present disclosure. In some variations, two radiators 9 and one driver 10 are provided. However, any number of radiators or drivers may be provided. As an example, the radiator 9 may be a Tectonic TEPR32 passive radiator and/or the driver 10 may be a Tectonic TEBM28C10-4/A miniature Balanced Mode Radiator (BMR) Full-Range speaker driver.

Figure 7:
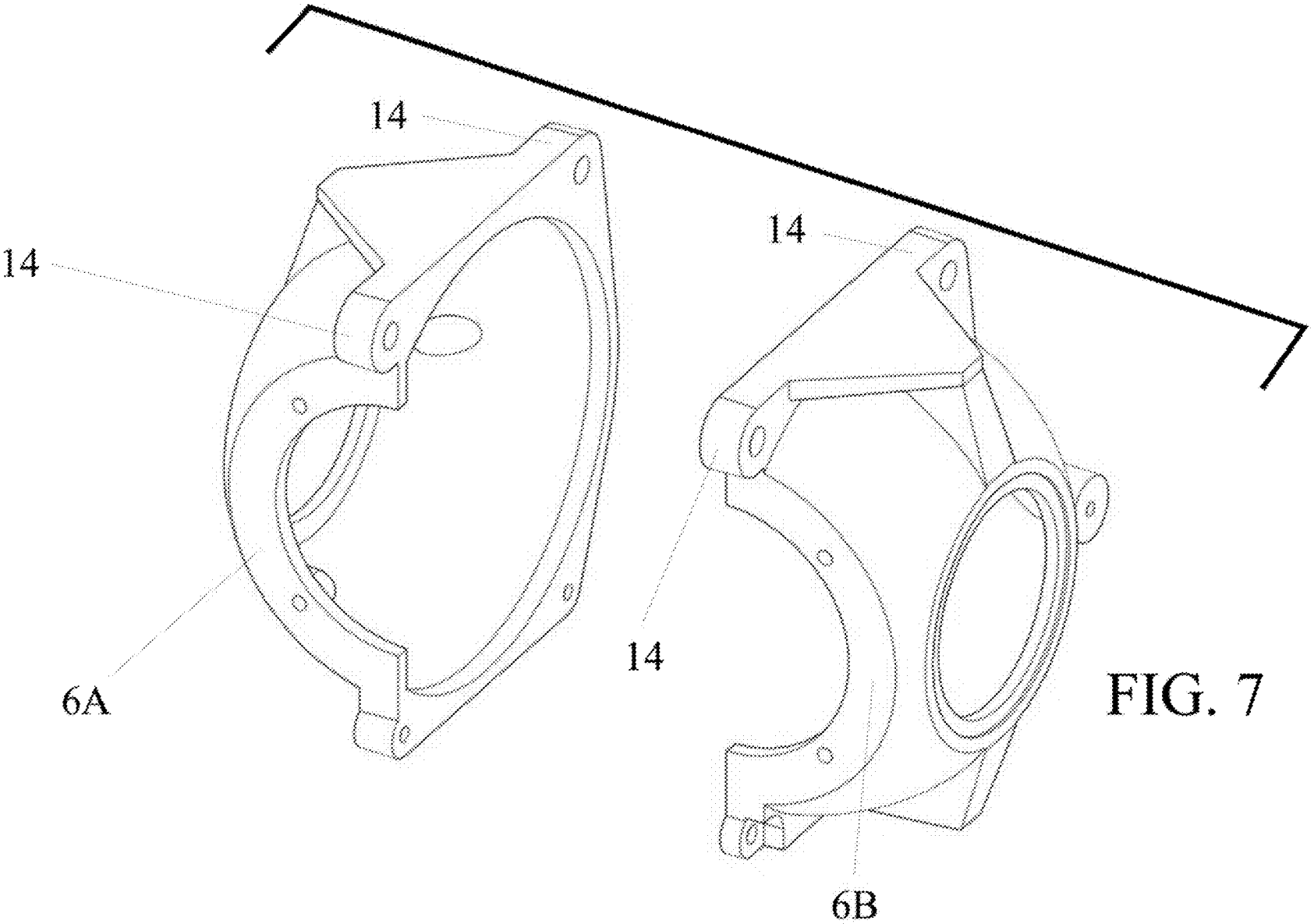
FIG. 7 is an exploded perspective view of a speaker housing according to the first embodiment of the present disclosure.

FIG. 7 is an exploded perspective view of a speaker housing 6 according to the first embodiment of the present disclosure. An interior of the speaker housing 6 is spheroidal. The term "spheroidal" as defined herein connotes that internal surfaces of the speaker housing 6 are arcuate and that the shape of the interior of the speaker housing 6 is spherical apart from openings, apertures or peripheral edges for the driver 10, the radiator 9, and any fasteners 8, 11, 12. Accordingly, the configuration of the interior of the speaker housing 6 minimizes or eliminates parallel paths for soundwaves. Therefore, standing waves, internal reflections, and reverberations on certain tones are mitigated because soundwaves bounce off of arcuate internal surfaces of the speaker housing 6 and do not bounce between two points on parallel surfaces. In other words, the speaker housing 6 provides damping and increases the attenuation of soundwaves by preventing the soundwaves from reverberating. The speaker housing 6 is designed to maximize the performance of the driver 10 by housing the driver 10 within a recommended cubic centimeter space from the manufacturer (e.g., Tectonic). The spheroidal shape of the speaker housing 6 also provides gaps between peripheral edges of the speaker housing 6 and the heat sink 5 so as to facilitate thermal management.

FIG. 8 is an exploded perspective view of the heat sink and the cap according to the first embodiment of the present disclosure. The cap 2 may include one or more buttons 15 for controlling various functions of the speaker 100 such as powering on or off, lowering or raising volume, etc. One of the buttons 15 may be a switch such as a SW-TS-M switch. In some variations, four buttons 15 may be provided. The speaker 100 may include a microphone 16, a circuit board 17, a support bracket 18, a circuit board 19, and a pad 20. The microphone 16 may be contained in the cap 2. In some variations, four microphones 16 may be provided. The support bracket 18 is fixed between the heat sink 5 and the cap 2. The circuit board 17 is fixed between the cap 2 and the support bracket 18. The circuit board 19 is fixed between the heat sink 5 and the support bracket 18. The support bracket 18 includes one or more protrusions 21 and the circuit board 19 includes one or more apertures 22. When the circuit board 19 is fixed to the support bracket 18, each protrusion 21 extends through a corresponding aperture 22. In some variations, the circuit board 17 may be a Micro-Electro-Mechanical Systems (MEMS) PCB and/or the circuit board 19 may be a Main Control PCB. The pad 20 may be thermally conductive and may function as a gap filler which provides an effective thermal interface between the heat sink 5 and the circuit boards 17, 19. Other elements such a USB interface, a light emitting diode (LED), a connector (e.g., a Flexible Printed Circuit (FPC) connector or surface mount terminal), a semiconductor (e.g., synchronous dynamic random access memory (SDRAM)), a socket (e.g., a burn-in socket), a metal-oxide-semiconductor field-effect (MOSFET) transistor and/or a shield may be provided. By mounting the speaker housing 6 directly to the heat sink 5, the heat sink 5 is configured to cool, for example, the circuit boards 17, 19. By mounting the speaker housing 6 to the heat sink 5 using the at least one of the Chicago screw 8A or the grommet 8B, the transfer of mechanical or vibrational noise to the circuit boards 17, 19 is reduced. The reduction of any mechanical or vibrational noise allows less software filtering to take place and reduces the overall complexity of the speaker 100.

Figure 9:
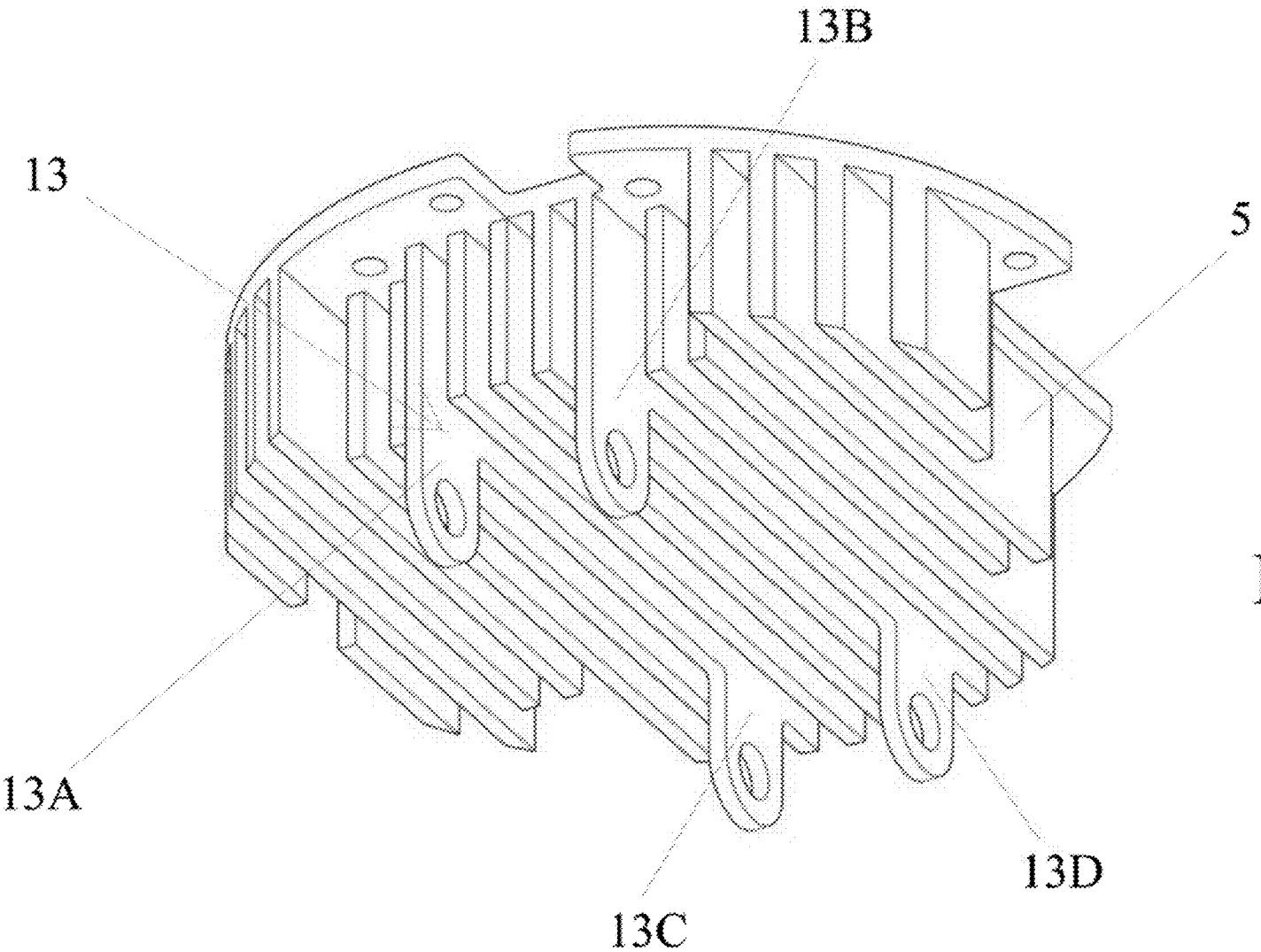
FIG. 9 is a bottom perspective view of the heat sink according to the first embodiment of the present disclosure.

FIG. 9 is a bottom perspective view of the heat sink 5 according to the first embodiment of the present disclosure. In some variations, the heat sink 5 may include four flanges 13A-13D to which four projections 14 of the speaker housing 6 are fixed. By including four flanges 13A-13D, a more rigid connection is provided for the speaker housing 6.

For the second embodiment of the present disclosure, like reference numerals refer to like parts throughout the various views unless otherwise specified and only the differences between the first embodiment and the second embodiment are described in detail below.

Figure 10:
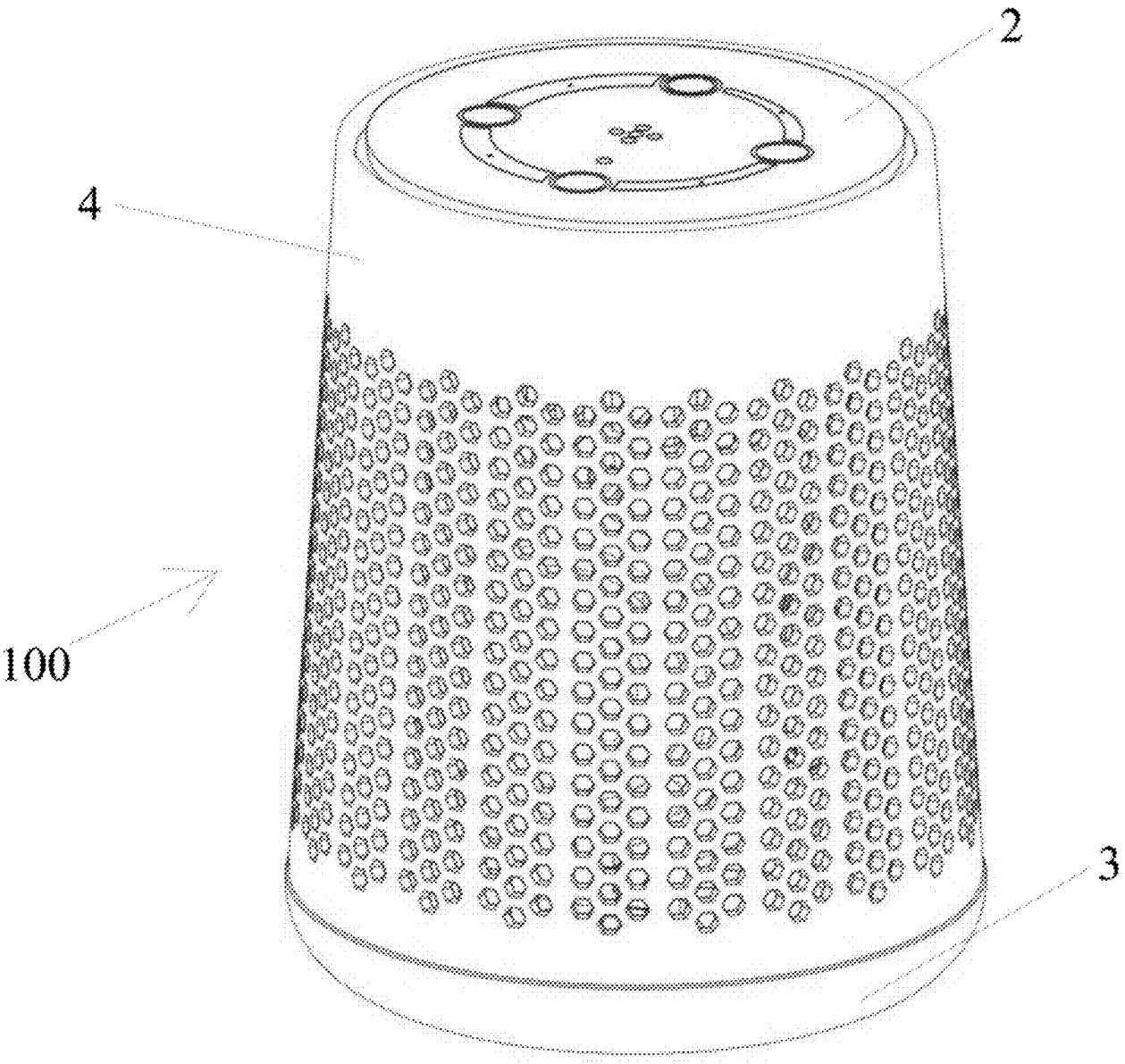
FIG. 10 is a perspective view of the speaker (without a covering) according to a second embodiment of the present disclosure.

FIG. 10 is a perspective view of the speaker 100 (without the covering 1) according to a second embodiment of the present disclosure.

Figure 11:
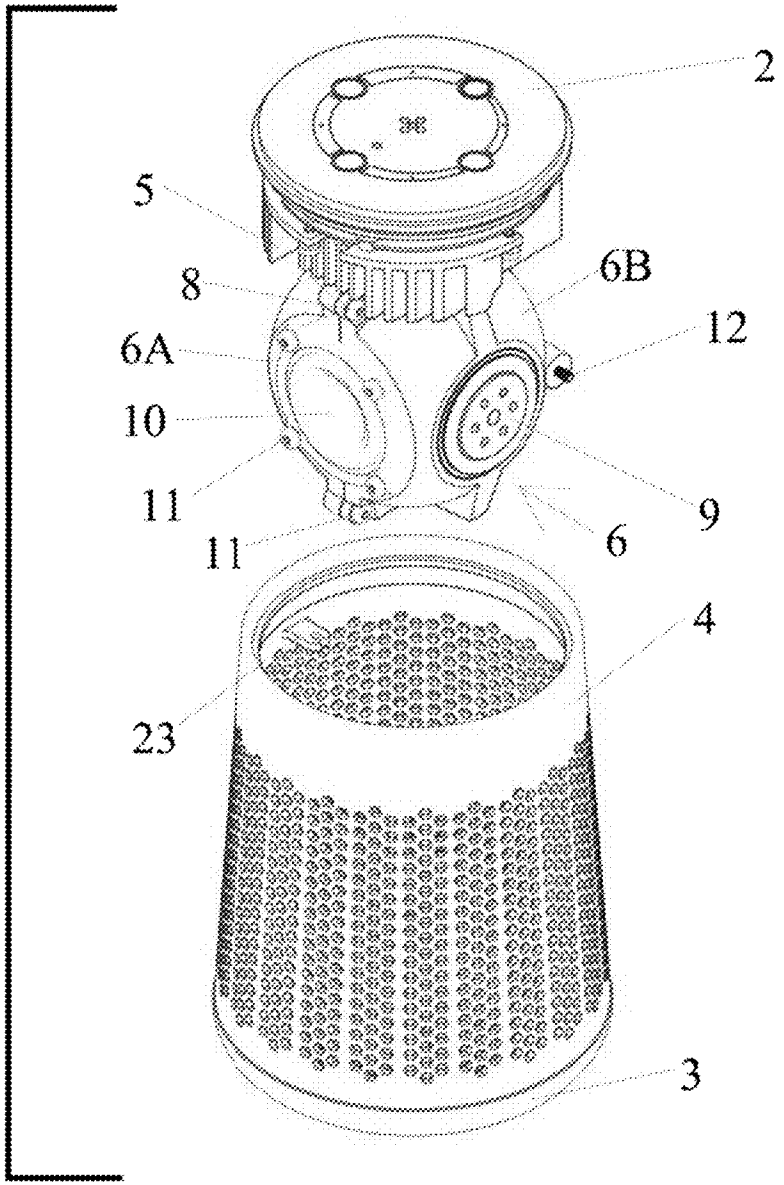
FIG. 11 is an exploded perspective view of a speaker subassembly, a cap, a shell and a base according to the second embodiment of the present disclosure.

FIG. 11 is an exploded perspective view of a speaker subassembly, the cap 2, the base 3 and a shell 4 according to the second embodiment of the present disclosure. The shell 4 may include a ledge 23 for supporting the heat sink 5.

Figure 12:
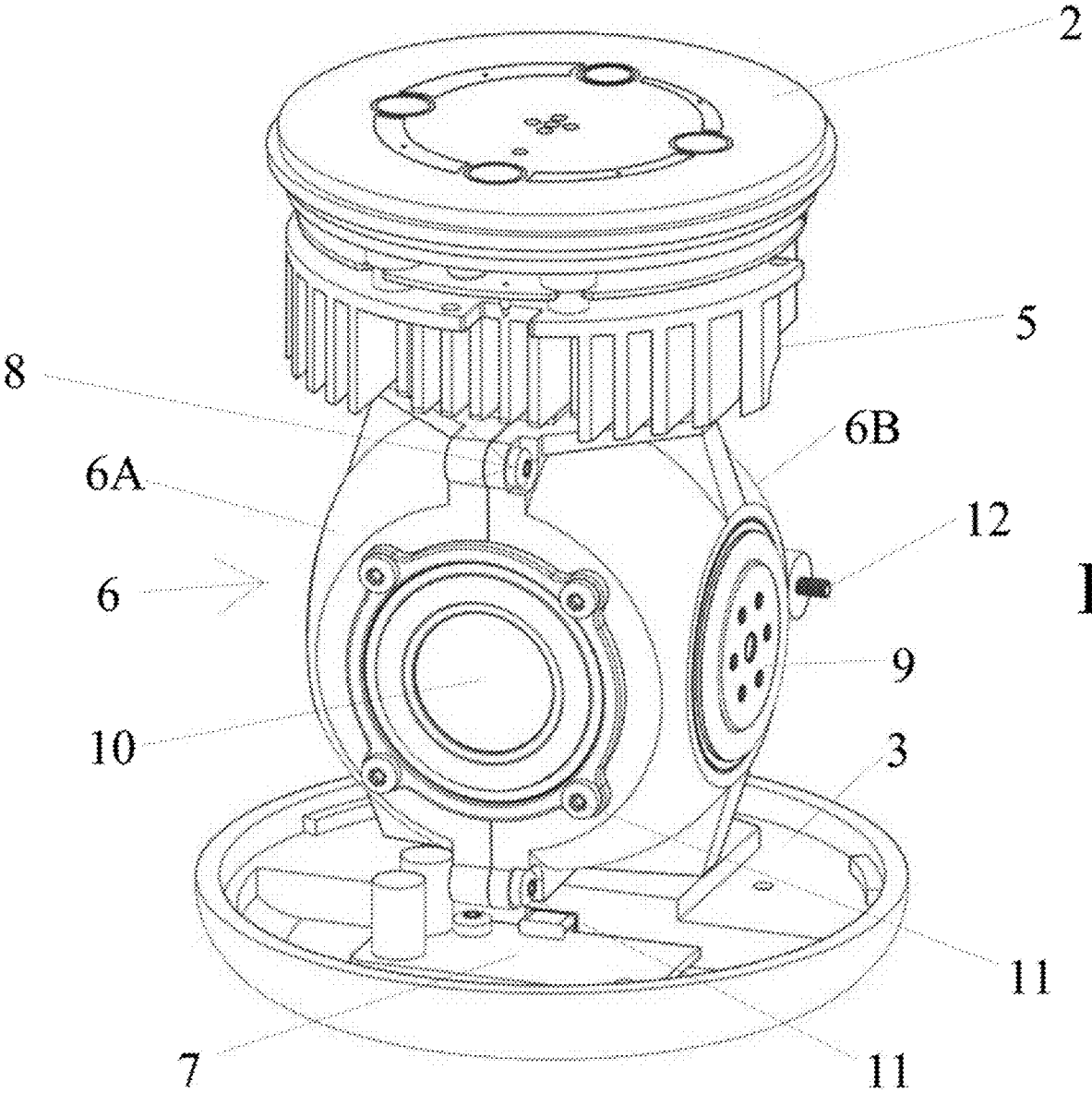
FIG. 12 is a perspective view of the speaker subassembly, the cap, and the base according to the second embodiment of the present disclosure.

FIG. 12 is a perspective view of the speaker subassembly, the cap 2, and the base 3 according to the second embodiment of the present disclosure.

Figure 13:
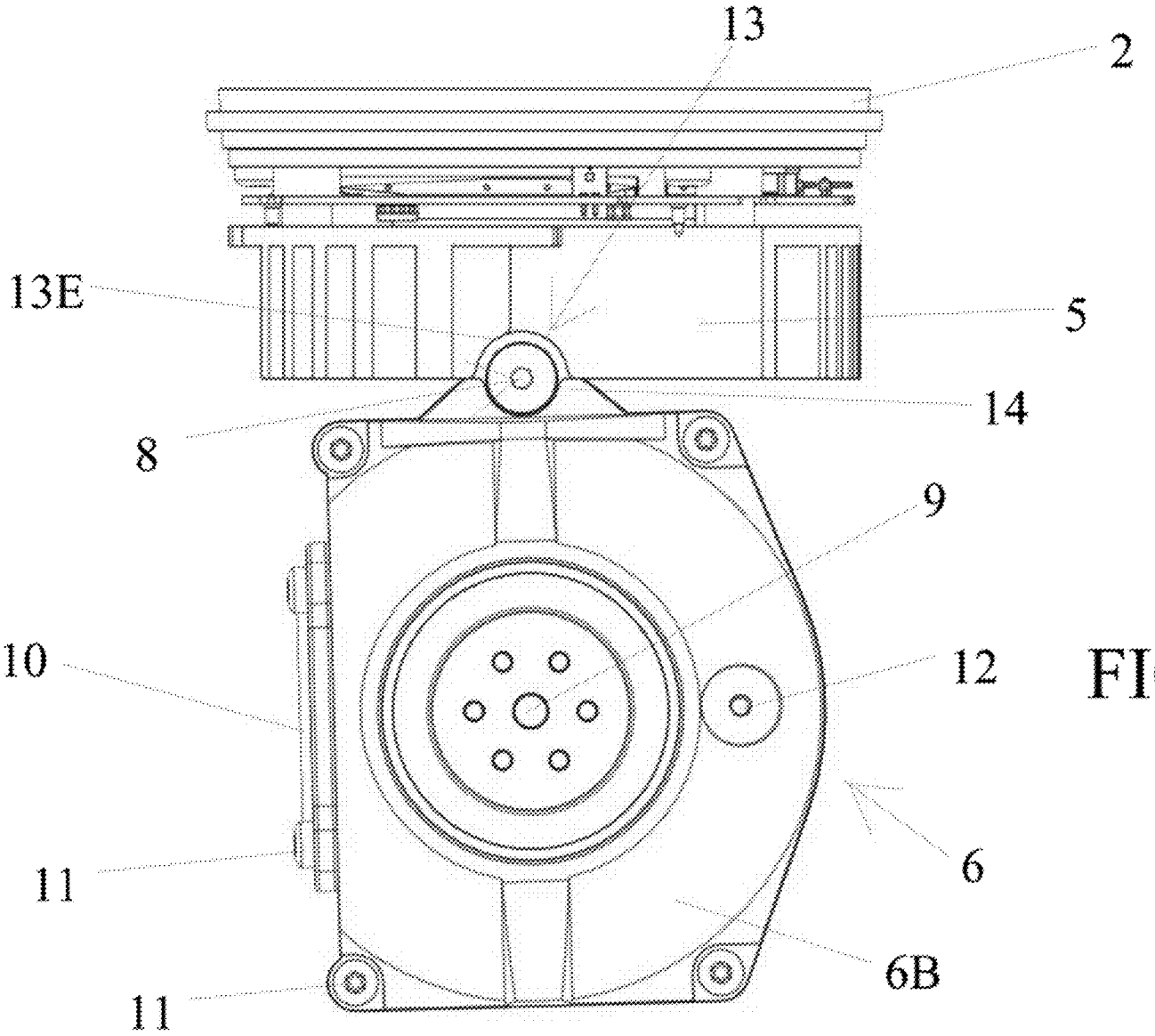
FIG. 13 is a side view of the speaker subassembly and the cap according to the second embodiment of the present disclosure.

FIG. 13 is a side view of the speaker subassembly and the cap 2 according to the second embodiment of the present disclosure.

Figure 14:
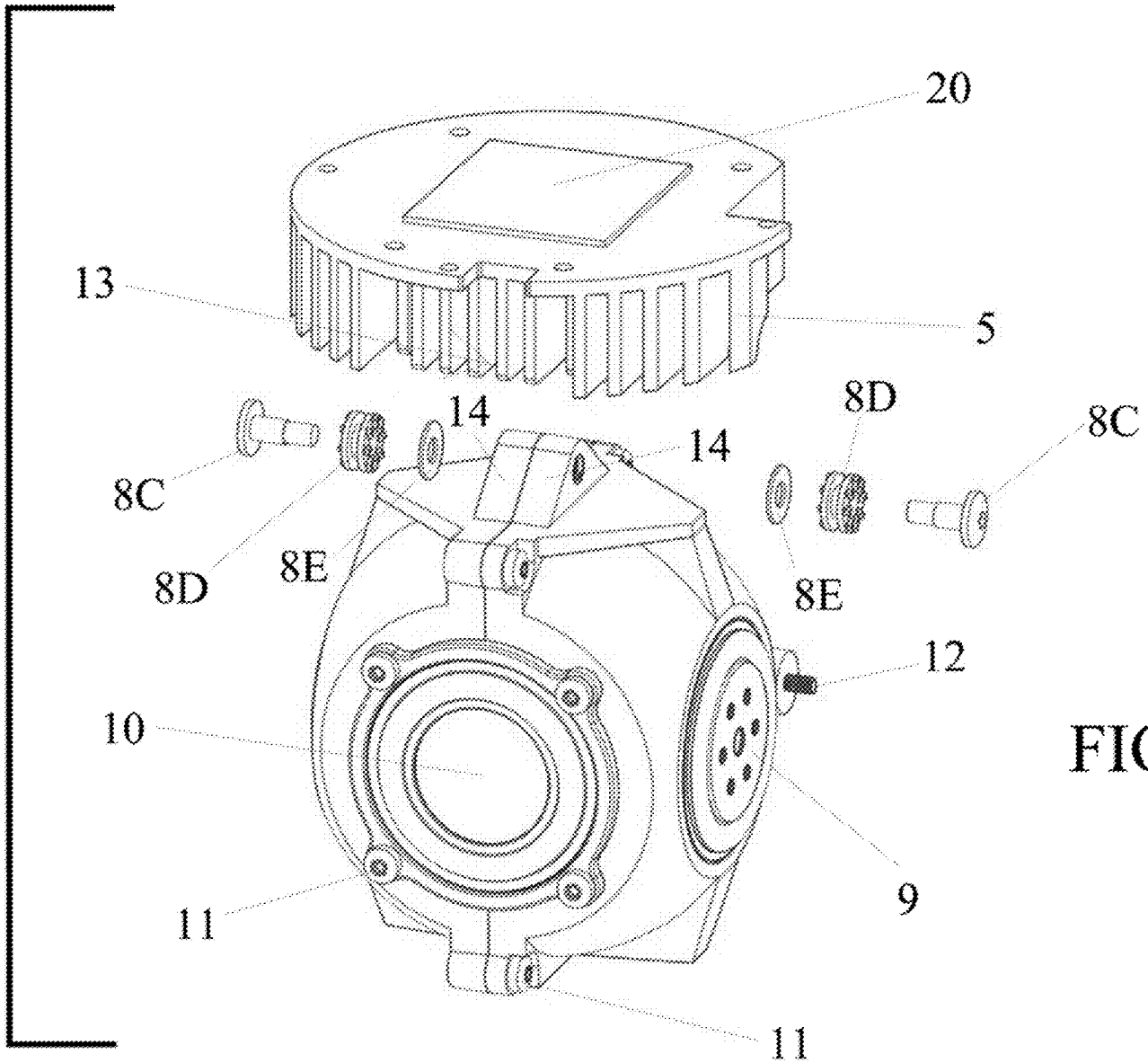
FIG. 14 is an exploded perspective view of the speaker subassembly according to the second embodiment of the present disclosure.

FIG. 14 is an exploded perspective view of the speaker subassembly according to the second embodiment of the present disclosure. In the second embodiment of the present disclosure, the at least one fastener 8 includes at least one of a Hard Disk Drive (HDD) screw 8C, a grommet 8D or a washer 8E; the heat sink 5 includes an attachment structure 13 on an underside thereof; and the speaker housing 6 includes at least one projection 14. For example, the attachment structure 13 includes eyelets 13E, 13F (see also FIG. 17). The projections 14 are fixed to the eyelets 13E, 13F via the fasteners 8. The speaker housing 6 is fixed to the heat sink 5 such that the speaker housing 6 is pivotable with respect to the heat sink 5. Each projection 14 may include a female threaded portion and each HDD screw 8C may include a male threaded portion. For example, (i) one HDD screw 8C can be inserted through a grommet 8D, a washer 8E, a first eyelet 13E of the heat sink 5, and secured to the female threaded portion in one projection 14 of the speaker housing 6. In some variations, two HDD screws 8C, two grommets 8D and two washers 8E may be provided. Accordingly, the transfer of mechanical or vibrational noise to the circuit boards 17, 19 is reduced. The reduction of any mechanical or vibrational noise allows less software filtering to take place and reduces the overall complexity of the speaker 100.

Figure 15:
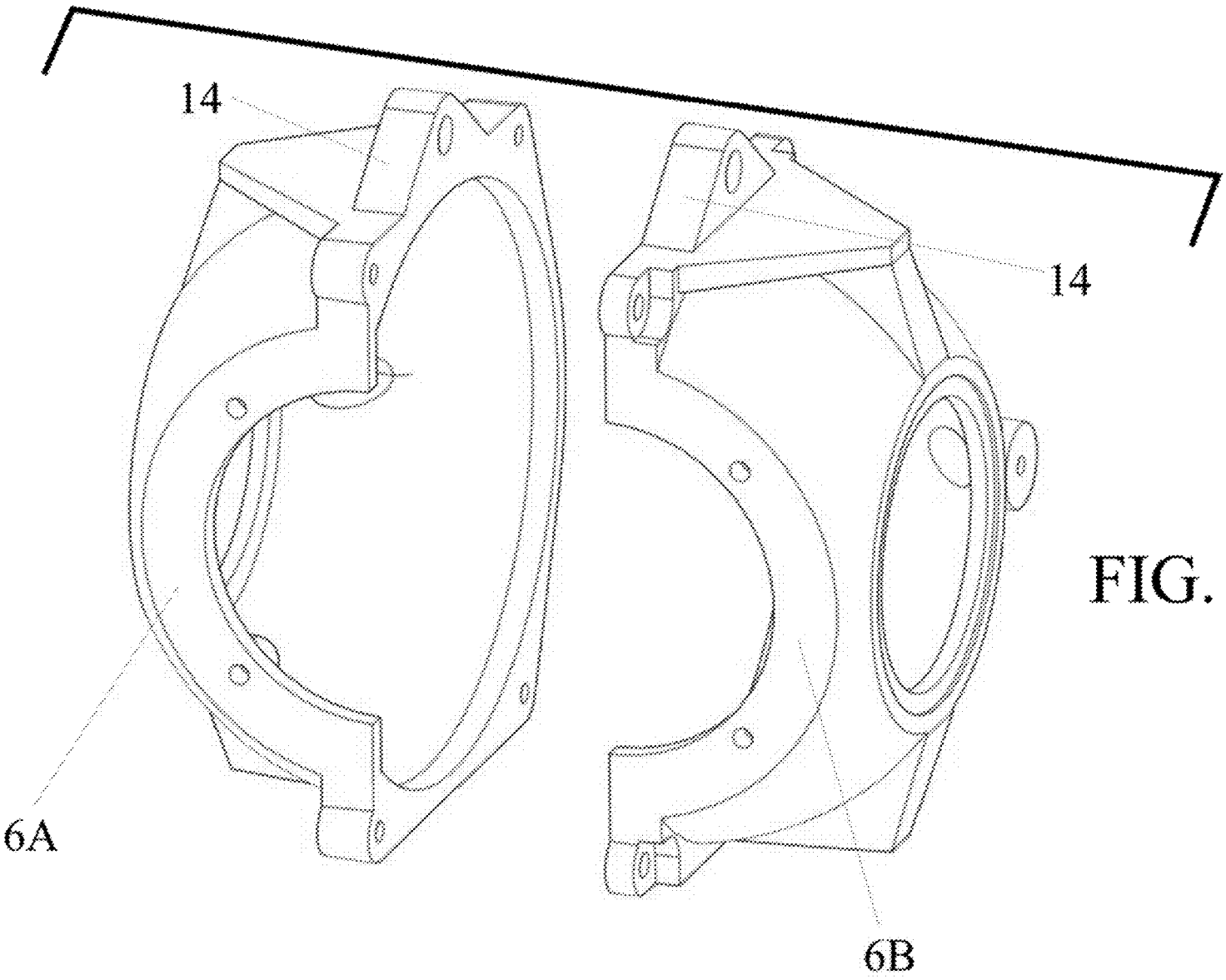
FIG. 15 is an exploded perspective view of a speaker housing according to the second embodiment of the present disclosure.

FIG. 15 is an exploded perspective view of a speaker housing 6 according to the second embodiment of the present disclosure.

Figure 16:
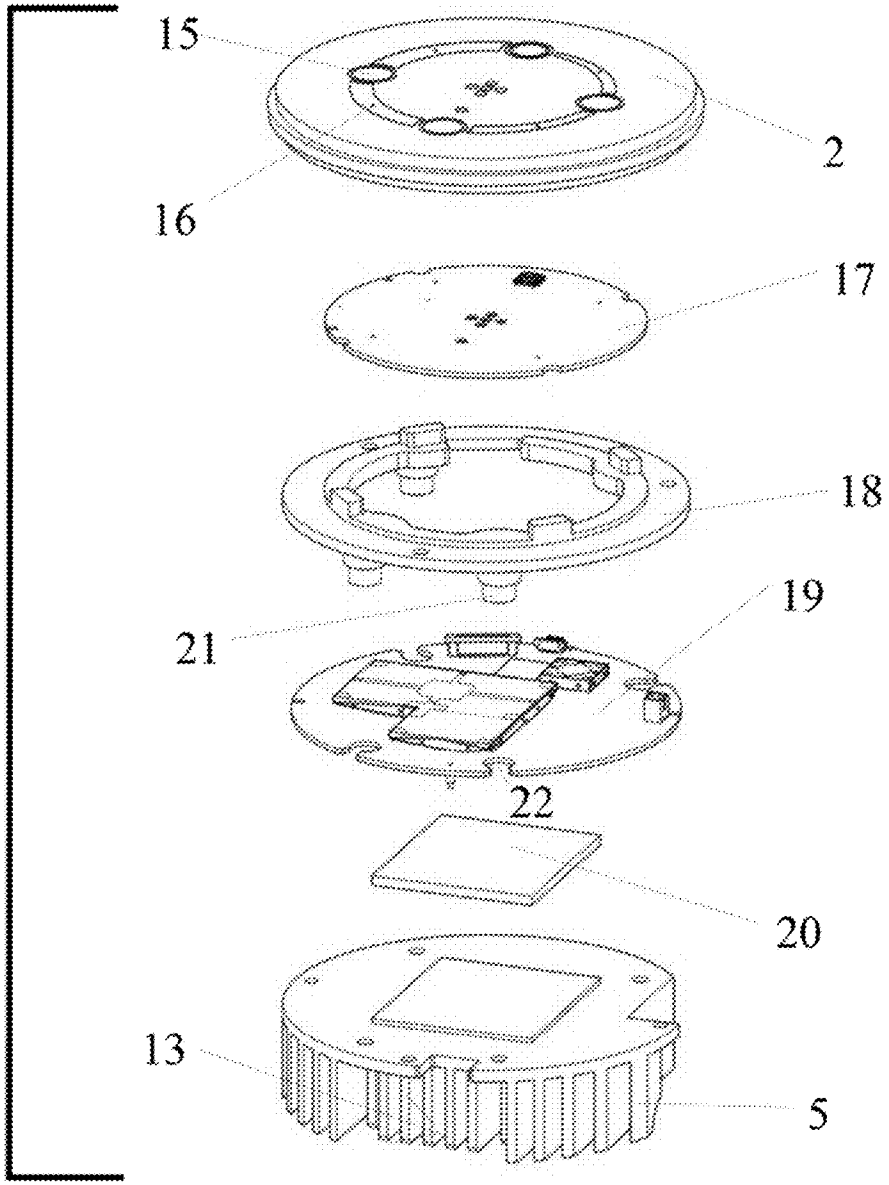
FIG. 16 is an exploded perspective view of the heat sink and the cap according to the second embodiment of the present disclosure.

FIG. 16 is an exploded perspective view of the heat sink 5 and the cap 2 according to the second embodiment of the present disclosure.

Figure 17:
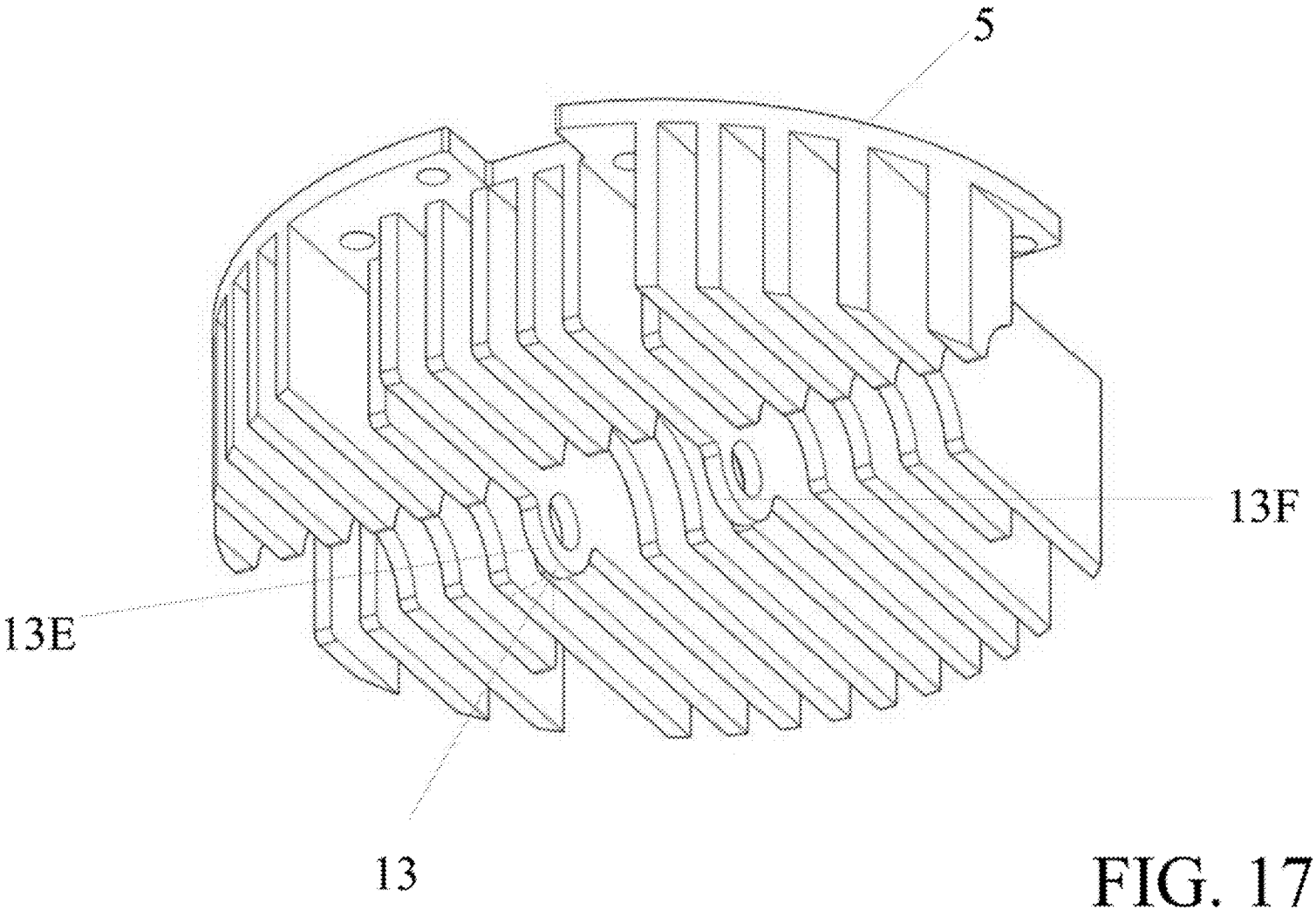
FIG. 17 is a bottom perspective view of the heat sink according to the second embodiment of the present disclosure.

FIG. 17 is a bottom perspective view of the heat sink 5 according to the second embodiment of the present disclosure. In some variations, the heat sink 5 may include two eyelets 13E, 13F to which two projections 14 of the speaker housing 6 are fixed. One grommet 8D can be attached to or integrated with each of the eyelets 13E, 13F.

The covering 1 can be comprised of, for example, a cloth material. The cap 2, the base 3, the shell 4 and the speaker housing 6 can be comprised of, for example, a plastic material. The heat sink 5 can be comprised of, for example, a metal material. The Chicago screws 8A can be comprised of, for example, a metal material. The HDD screws 8C can be comprised of, for example, a metal material. The grommets 8B, 8D can be comprised of, for example, a rubber material.

Use of the phrases "capable of," "capable to," "operable to," or "configured to" in one or more embodiments, refers to some apparatus, logic, hardware, and/or element designed in such a way to enable use of the apparatus, logic, hardware, and/or element in a specified manner. The subject matter of the present disclosure is provided as examples of apparatus, systems, methods, and programs for performing the features described in the present disclosure. However, further features or variations are contemplated in addition to the features described above. It is contemplated that the implementation of the components and functions of the present disclosure can be done with any newly arising technology that may replace any of the above implemented technologies.

Additionally, the above description provides examples, and is not limiting of the scope, applicability, or configuration set forth in the claims. Changes may be made in the function and arrangement of elements discussed without departing from the spirit and scope of the disclosure. Various embodiments may omit, substitute, or add various procedures or components as appropriate. For instance, features described with respect to certain embodiments may be combined in other embodiments.

I claim:

1. A speaker comprising:

a shell;

a speaker housing; and a heat sink, wherein:

the heat sink is fixed inside the shell;

the speaker housing is mounted to the heat sink such that the speaker housing is suspended from the heat sink inside the shell; and an interior of the speaker housing is spheroidal.

2. The speaker of claim 1, wherein the speaker housing is mounted to the heat sink via at least one of a Chicago screw or a grommet.

3. The speaker of claim 1, wherein the speaker housing is mounted to the heat sink via at least one of a Hard Disk Drive (HDD) screw, a grommet or a washer.

4. The speaker of claim 1, wherein:

the heat sink includes a flange extending therefrom;

the speaker housing includes a projection; and the projection is fixed to the flange via at least one of a Chicago screw or a grommet.

5. The speaker of claim 1, wherein:

the heat sink includes an eyelet extending therefrom;

the speaker housing includes a projection; and the projection is fixed to the eyelet via at least one of an HDD screw, a grommet or a washer.

6. The speaker of claim 1, further comprising:

a radiator; and a driver, wherein:

the radiator and the driver are fixed to the speaker housing; and the speaker housing is sealed.

7. The speaker of claim 1, further comprising:

a base, wherein the shell is fixed to the base.

8. The speaker of claim 7, wherein the speaker housing is mounted to the heat sink such that the speaker housing is suspended from the heat sink and spaced apart from the base.

9. The speaker of claim 1, further comprising:

a cap, wherein the cap is fixed to the heat sink.

10. The speaker of claim 9, further comprising:

a microphone, wherein the microphone is in the cap.

11. The speaker of claim 9, wherein the cap, the heat sink, and the speaker housing are configured to be inserted into the shell together from above.

12. The speaker of claim 9, further comprising:

a support bracket, wherein:

the support bracket is fixed between the heat sink and the cap.

13. The speaker of claim 12, further comprising:

a circuit board, wherein:

the circuit board is fixed between the heat sink and the support bracket.

14. The speaker of claim 13, wherein:

the support bracket includes a protrusion;

the circuit board includes an aperture; and the protrusion extends through the aperture.

15. A speaker subassembly comprising:

a speaker housing; and a heat sink, wherein:

the speaker housing is mounted to the heat sink such that the speaker housing is suspended from the heat sink; and an interior of the speaker housing is spheroidal.

16. The speaker subassembly of claim 15, wherein the speaker housing is mounted to the heat sink via at least one of a Chicago screw or a grommet.

17. The speaker subassembly of claim 15, wherein the speaker housing is mounted to the heat sink via at least one of a Hard Disk Drive (HDD) screw, a grommet or washer.

18. The speaker subassembly of claim 15, wherein:

the heat sink includes a flange extending therefrom;

the speaker housing includes a projection; and the projection is fixed to the flange via at least one of a Chicago screw or a grommet.

19. The speaker subassembly of claim 15, wherein:

the heat sink includes an eyelet extending therefrom;

the speaker housing includes a projection; and the projection is fixed to the eyelet via at least one of an HDD screw, a grommet or a washer.

20. The speaker subassembly of claim 15, further comprising:

a radiator; and a driver, wherein:

the radiator and the driver are fixed to the speaker housing; and the speaker housing is sealed.

* * * * *